United States Patent [19]

Kato et al.

[11] Patent Number: 5,005,021

[45] Date of Patent: Apr. 2, 1991

[54] ANTENNA UNIT FOR VEHICLE

[75] Inventors: Koichiro Kato; Hiroshige Fukuhara; Hiroyuki Kamishima; Hitoshi Tsukahara, all of Kanagawa, Japan

[73] Assignee: Nissan Motor Company, Limited, Yokohama, Japan

[21] Appl. No.: 389,448

[22] Filed: Aug. 4, 1989

[30] Foreign Application Priority Data

Aug. 8, 1988 [JP] Japan ..... 63-196146

[51] Int. Cl.[5] ..... H01Q 1/32

[52] U.S. Cl. ..... 343/717; 343/713; 343/878

[58] Field of Search ..... 343/717, 716, 713, 878

[56] References Cited

U.S. PATENT DOCUMENTS

| | | | |
|---|---|---|---|
| 2,055,830 | 9/1936 | Vincent | 343/717 |
| 2,095,934 | 10/1937 | Mitchell | 343/716 |
| 2,161,435 | 6/1939 | Smith | 343/716 |
| 2,863,143 | 12/1958 | Berlin | 343/717 |
| 3,497,808 | 2/1970 | Goodman et al. | 343/717 |

FOREIGN PATENT DOCUMENTS

| | | | |
|---|---|---|---|
| 604008 | 6/1948 | United Kingdom | 343/716 |

*Primary Examiner*—Rolf Hille
*Assistant Examiner*—Hoanganh Le
*Attorney, Agent, or Firm*—Pennie & Edmonds

[57] ABSTRACT

An antenna unit for an automotive vehicle is provided. This antenna unit is adapted to be located in a non-visible position on a vehicle and includes an grounding plate, a radiating conductive plate, and a loop antenna element which is interposed between the plates and is fixed thereto. The loop antenna is formed by two bars which have configurations symmetrical to each other. One end of each bar is folded at a right angle relative to the other end thereof. The ends of the bars are connected by elastically deformable connectors to define a loop and are electrically connected by a wire. By adjusting a length of the wire, easy tuning of the resonance frequency of the antenna unit can be obtained. The deformation of the connector absorbs shock given to the antenna unit by road obstacles such as stones or mud and guards it against impact damage.

17 Claims, 6 Drawing Sheets

ANTENNA UNIT FOR VEHICLE

BACKGROUND OF THE INVENTION

1. Technical Field

The present invention relates generally to an automotive antenna unit and more particularly, to an automotive antenna unit located on the underside of a vehicle body.

2. Background Art

Various types of antenna units for vehicles have been proposed. For example, a bar-type antenna units for use in automotive vehicular radio systems are well known in the art. Such antenna units however require housing space and must be positioned so as to be extendable without obstruction. Consequently, a small sensitive antenna element which may be installed at a non-visible position on a vehicle has been sought.

Such antenna units are generally disposed on a floor panel of a vehicle. An antenna unit typically includes an earth conductive plate fixed on the floor panel, a radiating conductive plate spaced- from the earth conductive plate by a given distance, and a feed pin, and a supporting pin each connecting between both conductive plates. In such an antenna unit, the radiating conductive plate projects downward from the bottom of the vehicle and it is a thin flat metal member, which is suspended by only the feed and the supporting pins. Thus, the mechanical rigidity of the radiating plate is relatively weak and therefore tends to receive shocks due to stones or mud on road surfaces. In the event an impact of stones or mud, breaking of the pins or disconnection between the conductive plates and the pins tends to occur. Additionally, in antenna elements of the prior art, adjustments of the distance between the radiating conductive plate and the earth conductive plate or of the particular geometry of the radiating conductive plate, according to the type of vehicle, are necessary in order to adjust resonance at the operating frequency of the antenna unit. Accordingly, a new conveniently adjustable type of antenna element with excellent durability under road conditions in different types of vehicles has long been sought by designers.

SUMMARY OF THE INVENTION

It is accordingly an object of the present invention to provide an antenna unit which is located at a non-visible portion of a vehicle and is yieldable so as to absorb impact due to road obstacles which could impair smooth functioning of the antenna unit.

It is another object of the invention to provide an antenna unit which is easily tuned to the operating frequencies applicable to different types of vehicles.

According to one aspect of the present invention, there is provided an antenna unit which comprises an antenna element member, a grounding plate located on the underside of the vehicle, a first supporting member fixed on the antenna element member, a second supporting member fixed on the grounding plate, and resilient connectors connecting end portions of the first supporting member to corresponding end portions of the second supporting member respectively so as to suspend the antenna element member from the grounding plate, one end portion of the first or second supporting member being provided as a terminal for feed.

According to another aspect of the invention, there is provided an antenna unit for a vehicle which comprises an antenna element member, a grounding plate located on the underside of a vehicle, a first shock absorbing means for absorbing impact caused by road obstacles hitting the antenna element member, and second shock absorbing means for absorbing impact with the first shock absorbing means to guard the antenna unit against impact damage, and for damping vibrations in cooperation with the first shock absorbing means, which are transmitted to the antenna element member from a vehicle body during driving. The first shock absorbing means includes a first supporting member fixed on the grounding plate, a second supporting member fixed on the antenna element member, and a first resilient connector connecting the first and second supporting members. The second shock absorbing means includes a third supporting member fixed on the grounding plate, a fourth supporting member fixed on the antenna element member, and a second resilient connector connecting the third and the fourth supporting members to support the antenna element member away from the grounding plate in cooperation with the first absorbing means.

According to a further aspect of the invention, there is provided an antenna unit for a vehicle which comprises an antenna element member, a grounding plate located on the underside of the vehicle, a first supporting member fixed on the antenna element member, a second supporting member fixed on the grounding plate, insulating connectors connecting end portions of the first supporting member to corresponding end portions of the second supporting member respectively so as to define a loop suspending the antenna element member from the grounding plate, an associated pair of connected end portions of the first and second supporting members being connected to a broadcast signal receiver via a cable, and a wire having a predetermined length, the wire electrically connecting the ends of the associated end portions of the first and second supporting members which are opposite the end portions connected to the broadcast signal receiver to adjust the impedance of the antenna unit so as to tune it to appropriate operating frequencies.

BRIEF DESCRIPTION OF THE DRAWINGS

FIG. 8 (*b*) is a front view which shows a coil type wire which is a modification of the wire connecting the terminals of an earth bar and a radiating element on a supporting connector.

FIG. 9 (*b*) is a perspective view which shows the installation of a wire on a supporting connector in the event that a long length of covered wire is provided to adjust the operating frequency of an antenna unit.

DESCRIPTION OF THE PREFERRED EMBODIMENT

Figure 1:
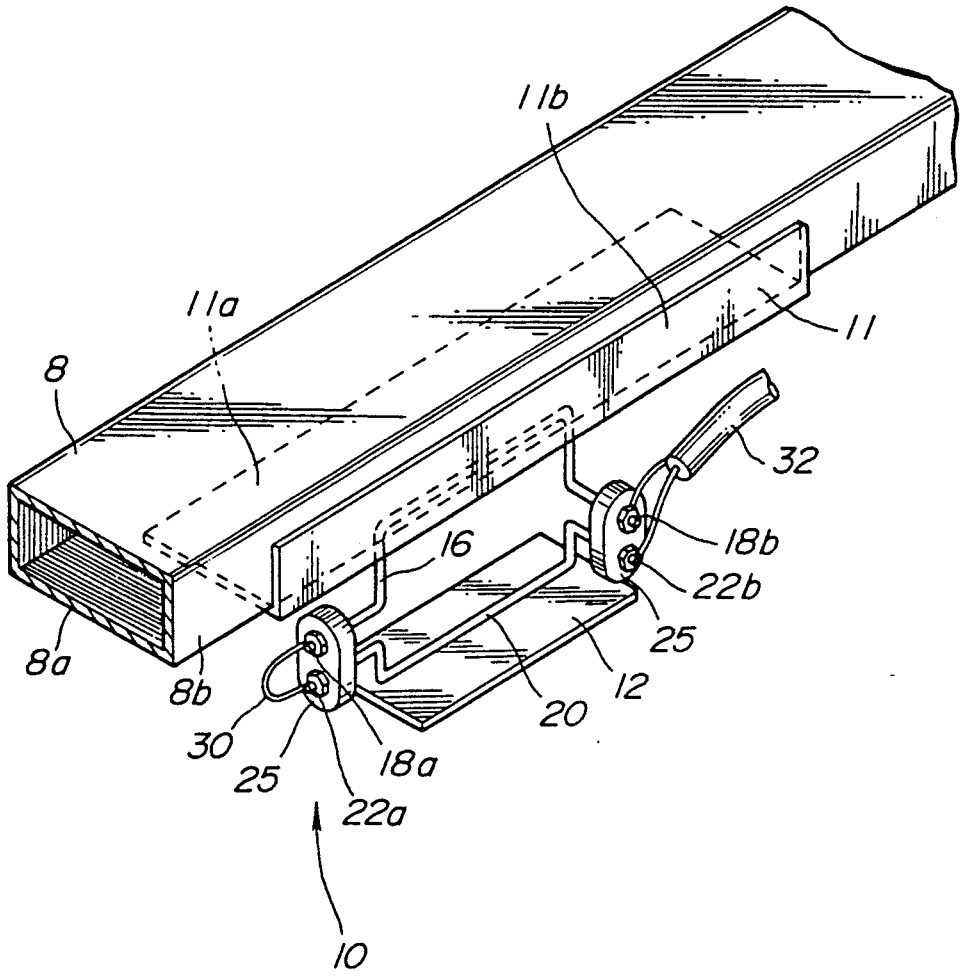
FIG. 1 is a perspective view which shows an antenna unit according to the present invention.
Figure 2:
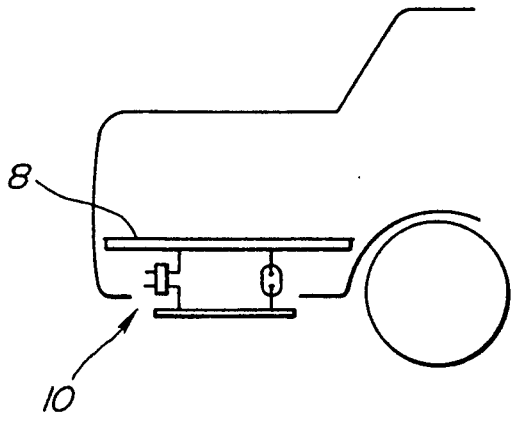
FIG. 2 is a side view which shows the location of an antenna unit according to the invention.
Figure 3:
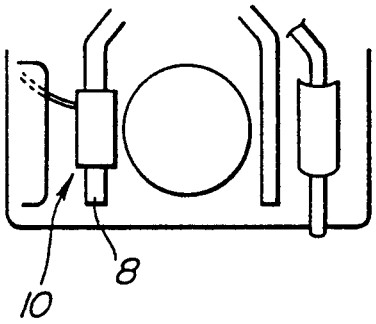
FIG. 3 is a bottom view of FIG. 2.

Referring now to the drawings, particularly to FIG. 1, an antenna unit according to the present invention is shown. This antenna unit 10 is, as shown in FIGS. 1 to 3, adapted to be attached to a rear chassis side member 8 of a vehicle frame.

The antenna unit 10 generally includes a grounding plate 11 functioning to earth the assembly and a radiating conductive plate 12, as an antenna element, arranged so as to be opposed to the grounding plate. The grounding plate 11 is in the form of an L-shape in cross section and is comprised of a bottom plate 11*a* and a raised plate 11*b* extending vertically from the bottom plate. The grounding plate 11 is attached to a rear underside member 8 so that the bottom plate 11*a* contacts with the bottom surface 8*a* while the raised plate 11*b* contacts a side wall 8*b* to provide easy attachment of the antenna unit to the rear chassis side member 8. By selecting appropriate geometry for the radiating conductive plate 12, a matched antenna or matched impedance, is provided.

Figure 4:
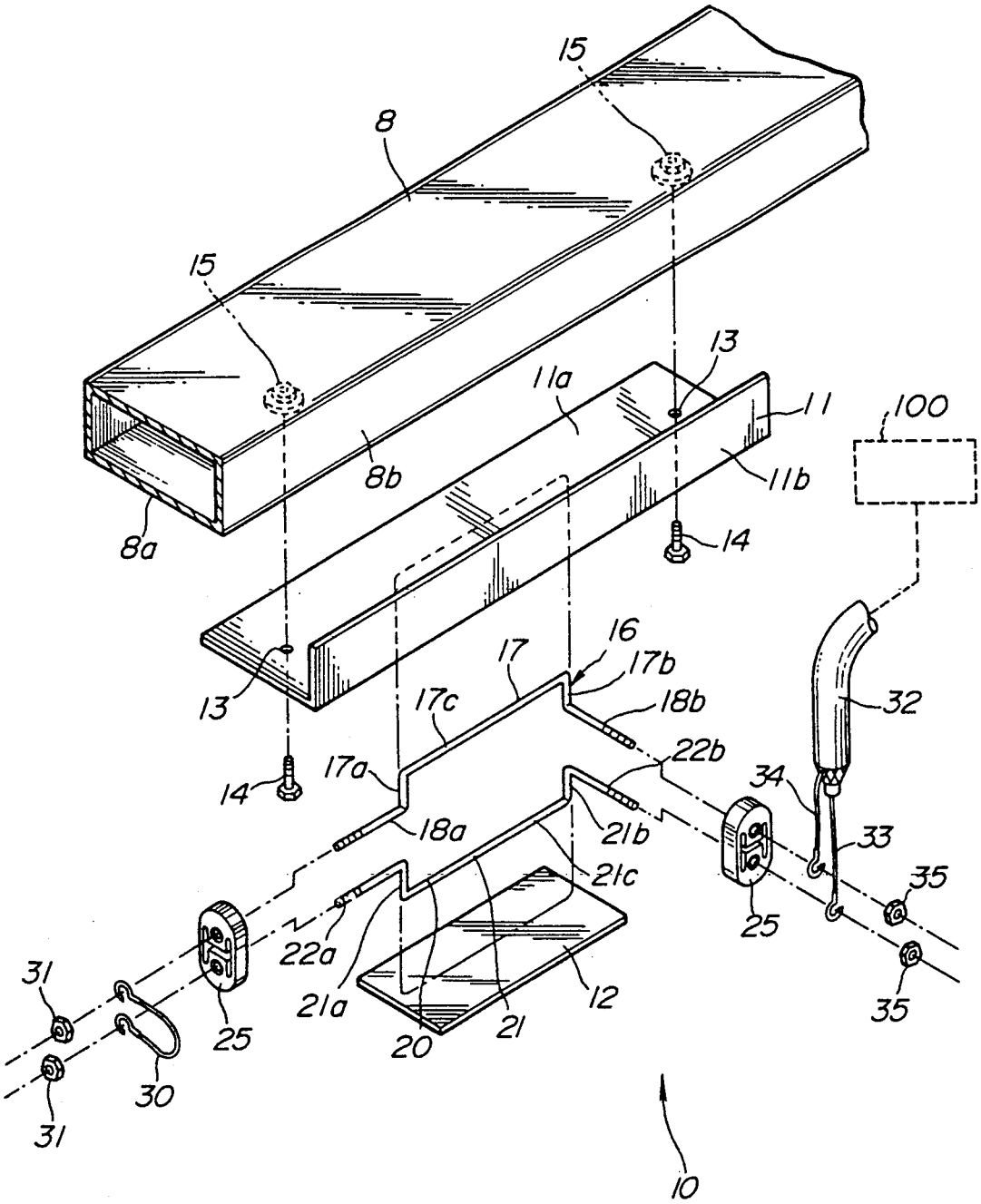
FIG. 4 is an exploded perspective view which shows the construction of an antenna unit according to the invention.

Referring to FIG. 4, the bottom plate 11*a* has boltholes 13 through which bolts 14 are inserted to engage weld nuts 15 mechanically welded on the bottom surface 8*a* of the rear chassis side member 8. Welded to the lower surface of the grounding plate 11 is a conductive metal bar 16 (hereinafter referred to as an earth bar). This earth bar 16 is comprised of a substantially U-shaped bar 17 and terminal bars 18*a* and 18*b* (hereinafter referred to as an earth terminal). The U-shaped bar 17 includes a straight section 17*c* fixed to the grounding plate 11 by welding and side sections 17*a* and 17*b*. The earth terminals 18*a* and 18*b*, are provided so as to extend perpendicularly from the side sections 17*a* and 17*b* to make right angles with each other. Also, the earth terminals 18*a* and 18*b* each have external threads. The reason for provision of these members at right angles to each other is that particular vibrations, generated during driving, in directions allowed by one supporting connector, are damped by the other supporting connector to prevent the antenna unit from being damaged due to vehicle body vibrations encountered under driving conditions.

On the radiating conductive plate 12, a conductive metal bar 20 (hereinafter referred to as the radiating element) having a configuration symmetrical to that of the earth bar 16 is fixed. This radiating element 20 is provided with a U-shaped bar 21 and terminal bars 22*a* and 22*b* (hereinafter referred to as radiating terminals). The bar 21 includes a straight section 21*c* fixed on the upper surface of the radiating conductive plate 12 so as to extend in the longitudinal direction thereof and side sections 21*a* and 21*b* vertically extending from both end sections thereof.

Figure 5:
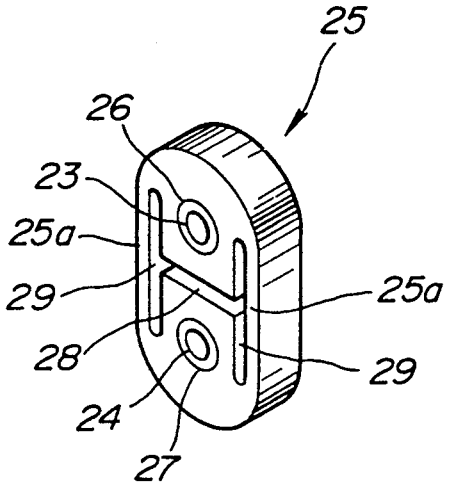
FIG. 5 shows a supporting connector for connecting an earth bar and a radiating element to define a loop antenna for an antenna unit according to the invention.

The earth bar 16 and the radiating element 20 are connected to each other by a pair of supporting connectors 25 to define a loop. The supporting connector 25, as shown in FIG. 5, is in the form of an ellipse and is made of a resilient insulating material such as rubber. The supporting connector 25 has through holes 26 and 27 in the upper and lower sides in the drawing. A collar 23 for receiving the earth terminals 18*a* or 18*b* of the earth bar 16 is inserted into the upper through hole 26, while a collar 24 for receiving radiating terminals 22*a* or 22*b* of the radiating element 20 is inserted into the lower through hole 27. Provided between the through holes 26 and 27 is a laterally extending groove 28. On both sides of this groove 28, vertically extending grooves 29 are formed defining an H-shape in conjunction with the groove 28, improving elastic properties of the supporting connector. The earth bar 16 and the radiating element 20 are inserted into the corresponding collars respectively to be mechanically connected to each other.

In addition to the mechanical connection, the earth terminal 18*a* and the radiating terminal 22*a* are electrically connected to each other by a wire 30. Nuts 31 are fastened to the external threads of the radiating terminal and the earth terminal to fix the wire 30 thereto.

Further, the other earth terminal 18*b* and the radiating terminal 22*b* are connected to an external wire 34 and an core wire 33 of a coaxial cable 32 as a feeder by nuts 35 respectively. This feeder is connected to a broadcast signal receiver 100 such as a radio or a television provided within a vehicle.

The above described antenna unit 10 according to the present invention is assembled by the following steps.

First, the earth bar 16 is welded to the grounding plate 11 to be fixed thereon.

At the same time, the radiating element 20 is welded to be fixed on the radiating conductive plate 12.

Next, the conductive plates 11 and 12 are disposed so that the earth bar 16 and radiating element 20 are symmetrically arranged.

With this arrangement, the supporting connections 25 are inserted into the terminals 18*a* and 21*a* of one side and into the terminals 18*b* and 21*b* of the other side.

Finally, the terminals 18*a* and 21*a* are electrically connected to each other by the wire 30 to form the antenna unit 10 as an antenna pre-assembly.

Figure 6:
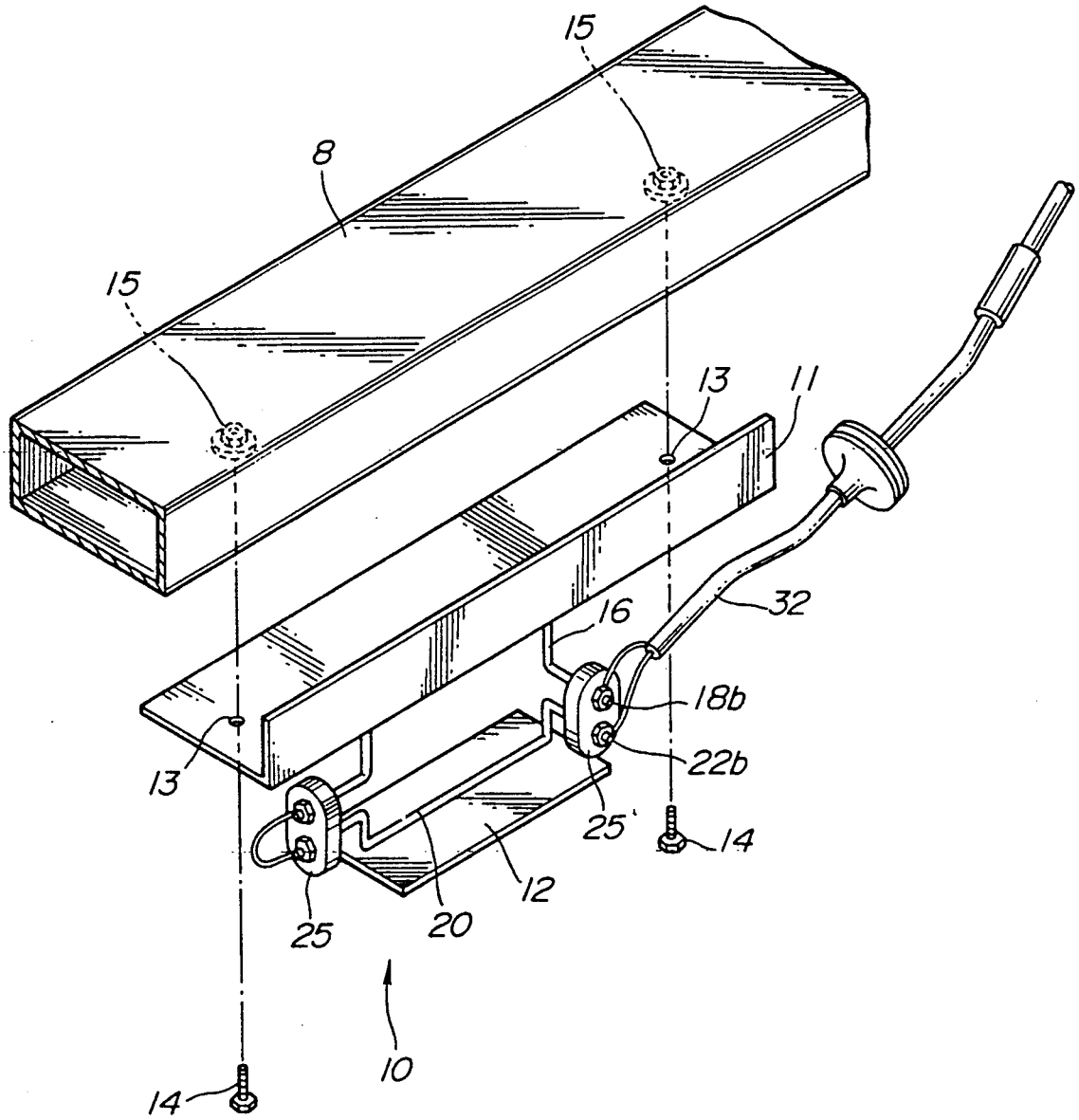
FIG. 6 is an explanatory view which shows the assembly of an antenna unit installed on a rear side member of a vehicle frame.

The mounting of this antenna pre-assembly fabricated in the above manner to a vehicle, as shown in FIG. 6, begins with connection of a feeder 32 to the terminals 18*b* and 22*b*. Then, the bolts 14 are inserted into the boltholes of the grounding plate 11 4nd are screwed into the weld nuts 15 of the rear chassis side member 8. On the grounding plate 11, no protrusions such as connectors are provided, unlike conventional antenna units, therefore provision of an opening for receiving a connector in the rear chassis side member is unnecessary. This results in simplified assembly.

Moreover, if road objects such as stones or mud hit the radiating conductive plate 12 of the antenna unit during driving, the supporting connectors 25 are elastically deformed by the impact, this deformation absorbs the impact transmitted to the grounding plate through the radiating element 20 and the earth bar 16 to guard the antenna unit 10 against road obstacles which would impair the smooth functioning thereof.

In the supporting connector 25, as described above, an H-shaped groove is formed to define thin walls 25*a* at both sides of the supporting connector. Thus, the walls 25*a* are subject to bending and torsion to provide the supporting connector a tendency to be deformed easily. It will be appreciated that the supporting connector has high impact absorbing properties and thus can serve to prevent the earth bar 16 and the radiating element 20 from receiving extreme impact impinging upon the antenna unit.

Additionally, the radiating element 20 is welded on the radiating conductive plate 12 in the longitudinal direction to provide high rigidity of the radiating conductive plate. Therefore, the radiating conductive plate 12 resists bending due to collision with obstacles such as protrusions or stones.

The right relationship between the extending directions of the radiating terminals 18*a* and 22*a* and the earth terminals 18*b* and 22*b*, as described above, can prevent the antenna unit from deleterious shaking as a result of vibrations occurring during driving.

Figure 7:
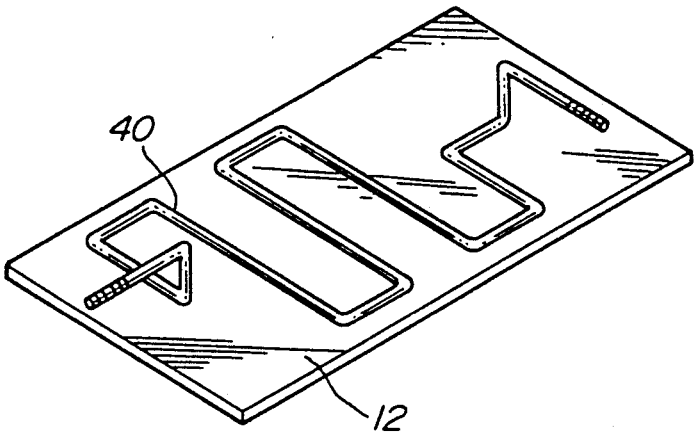
FIG. 7 is a perspective view which shows a second embodiment as to the connection of a radiating element to a radiating conductive plate in an antenna unit according to the invention.

The shapes of the earth bar 17 and the radiating element 20 are not limited to the above described shapes. For example, a bar antenna 40 may be folded several times over to form a folded shape as shown in FIG. 7. In this shape, contact area between the bar antenna and the radiating conductive plate 12 increases by the folded length of the bar to improve its rigidity so as to prevent the conductive plate 12 from further deformation.

When applying the antenna unit of the above described embodiment to different vehicles and when the receiving frequency of an antenna is changed, changing the length of the wire 30 tends to cause return loss to vary, thereby causing the bandwidth of the resonance frequency to vary. In this case, it has been found in experiments that by adjusting a length of the wire 30 alone, without changing the shape of the radiating conductive plate 12 or the position of the feed point or the connection between the earth bar and the radiating element, the antenna unit can be tuned to correct for any shift in the resonance frequency due to the antenna mounting position or vehicle configuration. Thus, by adjusting only the length of a wire, the desired resonance frequency can be provided.

Figure 8:
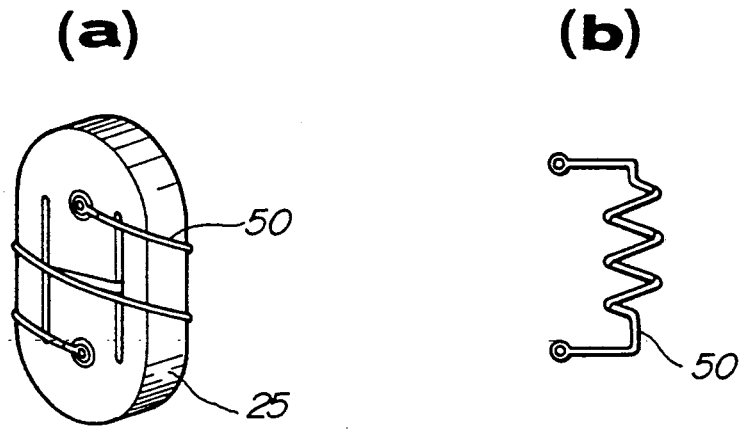
FIG. 8 (*a*) is a perspective view which shows the installation of a wire connecting the terminals of an earth bar and a radiating element on a supporting connector in the event that a relatively long wire is provided in order to tune an antenna unit to a required operating frequency.

When a wire 30 having a relatively great length must be provided in order to adjust the resonance frequency bandwidth to desired value, as shown in FIG. 8, the wire may be wound helically around the supporting connector 25, or a coil type wire, as shown in FIG. 8 (2) may be used to secure the wire 30 to prevent it from being caught by other parts or reducing the performance stability of the antenna by vibrating excessively.

Figure 9:
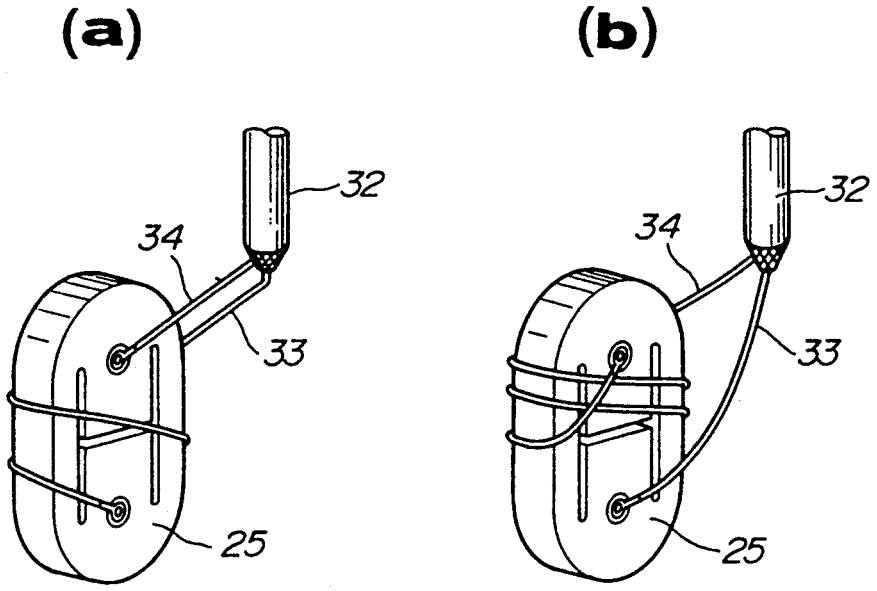
FIG. 9 (*a*) is a perspective view which shows the installation of a wire on a supporting connector in the event that a long length of exposed core wire is provided to adjust the operating frequency of an antenna unit.

To tune the antenna unit to the resonance frequency and its band width, as shown in FIG. 9, changing of length of the core wire 33 and/or the external wire 34 of the coaxial cable 32 may be provided in place of the adjustment of a length of the wire 30 or with the adjustment thereof.

The geometries of the plates 11 and 12 and the supporting connector 30 are not limited to the above described embodiment. Various modifications thereof may be applied for adjusting the resonance frequency bandwidth or so forth.

As described above, in an antenna unit according to the present invention, connection between the radiating element and the earth bar by means of an elastic material is provided. Thus, even if road objects such as stones or mud hit the radiating element to give a shock thereto, the elastic material can absorb the impact to reduce damage. As a result, load weight exerted on the grounding plate, the radiating conductive plate and the loop antenna is reduced to prevent damage, such as breaking of the loop or the disconnection of wire from the loop, from occurring.

Further, since parts of the loop antenna are adapted to serve as feed terminals, the provision of a separate connector as a terminal on the grounding plate is unnecessary. It will be noted that no part of the antenna unit interferes with any vehicle parts, simplifying assembly operations for fixing the antenna unit to the vehicle effectively.

The antenna unit according to the invention, as described above, is adapted to be located on the underside of an automotive vehicle, especially on a rear chassis side member thereof. The antenna unit may be however installed any other appropriate place on a vehicle as well. According to the installing position an antenna unit is frequency influenced by factors such as engine noise, for example. In such situations, it is preferable that a shielding plate be disposed between the antenna unit and any noise source on a vehicle to shield the antenna against noise. The following application discloses an automotive antenna unit having such a shielding plate. This shielding plate is applicable to the present invention.

The shielding plate has been disclosed in U.S. Pat. Application No. 213,173 filed on June 29, 1988, entitled "ANTENNA UNIT FOR A VEHICLE" by Kouichiro KATOH et al., assigned to NISSAN MOTOR CO., LTD, the disclosure of which is incorporated therein by reference.

What is claimed is:

1. An antenna unit for a vehicle comprising:

an antenna element member;

a grounding plate located on the underside of the vehicle;

a first supporting member fixed on said antenna element, said first supporting member having first and second end portions;

a second supporting member fixed on said grounding plate, said second supporting member having first and second end portions;

resilient connectors, made of insulating materials, non-conductively connecting the first and second end portions of said first supporting member to the first and second corresponding end portions of said second supporting member respectively so as to suspend said antenna element member from said grounding plate, respective first end portions of said first and second supporting members being provided as terminals for feed; and a wire, having a predetermined length, electrically connecting respective second end portions of said first and second supporting members to adjust the impedance of the antenna unit so as to tune it to appropriate operation frequencies.

2. An antenna unit as set forth in claim 1, wherein said terminals are connected to a broadcast signal receiver for conveying broadcast signals thereto via a cable, said cable including exposed conductive wires having predetermined lengths so as to tune the antenna unit to a desired operating frequency.

3. An antenna unit as set forth in claim 1, wherein said resilient connectors absorb impact caused by road obstacles hitting said antenna element member to guard the antenna unit against impact damage, each one of the resilient connectors damping vibrations allowed by the other so as to prevent said antenna element member from resonating with vehicle body vibrations encountered under driving conditions.

4. An antenna unit as set forth in claim 3, wherein the first end portions of said first and second supporting members folded so as to extend in a given direction and the second end portions thereof are folded so as to extend at a right angle relative to the former to damp vibrations transmitted to said antenna element member due to vehicle body vibrations encountered under road conditions during driving.

5. An antenna unit for a vehicle comprising:

an antenna element member;

a grounding plate located on the underside of a vehicle;

first shock absorbing means for absorbing impact caused by road obstacles hitting said antenna element member, said first shock absorbing means including a first supporting member which has first and second end portions, a second supporting member which has first and second end portions, and a first resilient connector, the first end portion of the first supporting member being fixed on said grounding plate, the first end portion of the second supporting member being fixed on said antenna element, the first resilient connector connecting respective second end portions of the first and second supporting members so as to be allowed to deform in a first direction to damp vibrations which are transmitted to said antenna element member from a vehicle body during driving; and second shock absorbing means for absorbing impact with said first shock absorbing means to guard the antenna unit against impact damage, said second shock absorbing means including a third supporting member which has first and second end portions, a fourth supporting member which first and second end portions, and a second resilient connector, the first end portion of the third supporting member being fixed on said grounding plate, the first end portion of the fourth supporting member being fixed on said antenna element, the second resilient connector connecting respective second end portions of the third and fourth supporting members so as to be allowed to deform in a second direction substantially perpendicular to the first direction to damp vibrations allowed by said first absorbing means as to prevent said antenna element member from resonating which vehicle body vibrations encountered under driving conditions.

6. An antenna unit as set forth in claim 5, wherein respective second the end portions of said first and said second supporting members are curved in a given direction and are non-conductively connected by said first resilient connector, respective second the end portions of said third and said fourth supporting members being folded so as to extend substantially perpendicular to said curved end portions of said first and second supporting members and being non-conductively connected by said second resilient connector, each of the first and second shock absorbing means damping vibrations allowed by the other so as to prevent said antenna element member from resonating with vehicle body vibrations encountered under driving conditions.

7. An antenna unit as set forth in claim 5, wherein said second and fourth supporting members fixed on said antenna element member are integrally formed into a substantially U-shaped member, the middle portions thereof being attached to said antenna element member along the longitudinal direction thereof to improve its rigidity.

8. An antenna unit as set forth in claim 7, wherein the middle portion of the U-shaped member which is attached to said antenna element member is folded several times over so as to increase its contact area with the antenna element member to further improve the rigidity thereof.

9. An antenna unit as set forth in claim 5, wherein said first and second resilient connectors are made of a insulating material, said first, second, third, and fourth supporting members each being made of a conductive material, said resilient connectors mechanically connected between respective second end portions of said first and second supporting members and between respective second end portions of said third and fourth supporting members so as to electrically insulate them from each other, the second end portions of said first and second supporting members being electrically connected by a wire having a predetermined length so as to tune the antenna unit to a desired resonance frequency.

10. An antenna unit as set forth in claim 5, wherein said first and second resilient connectors are each made of an insulating material, said first, second, third, and fourth supporting members each being made of a conductive material, said resilient connectors mechanically connecting between respective second end portions of said first and second supporting members and between respective second end portions of said third and fourth supporting members being electrically connected by a wire, the second end portions of said third and fourth supporting members being connected to a broadcast signal receiver for reproducing broadcast signals via wires having predetermined lengths so as to tune the antenna unit to a desired resonance frequency.

11. An antenna unit as set forth in claim 10, wherein one of said wires which connect between said third supporting member and the broadcast signal receiver is different in length from the other by a predetermined length so as to tune the antenna unit to a desired resonance frequency.

12. An antenna unit for a vehicle comprising:

an antenna element member;

a grounding plate located on the underside of the vehicle;

a first supporting member fixed on said antenna element member;

a second supporting member fixed on said grounding plate;

insulating connectors connecting end portions of said first supporting member to corresponding end portions of said second supporting member respectively so as to define a loop suspending said antenna element member from said grounding plate, an associated pair of connected end portions of said first and second supporting members being connected to a broadcast signal receiver via a cable; and a wire having a predetermined length, said wire electrically connecting the ends of the associated end portions of said first and second supporting members which are opposite the end portions connected to the broadcast signal receiver to adjust the impedance of the antenna unit so as to tune it to appropriate operating frequencies.

13. An antenna unit as set forth in claim 12, wherein said cable includes an exposed conductive wire having a predetermined length so as to tune the antenna unit to the desired operating frequency.

14. An antenna unit as set forth in claim 12, wherein said insulating connectors are made of elastic materials so as to absorb impact caused by road obstacles hitting said antenna element member to guard the antenna unit against impact damage.

15. An antenna unit as set forth in claim 12, wherein one end portion of said first and second supporting members is folded so as to extend in a given direction and the other end portion thereof is folded so as to extend at a right angle relative to the former to damp vibrations transmitted to said antenna element member due to vehicle body vibrations encountered under road conditions during driving.

16. An antenna unit as set forth in claim 12, further comprising shielding means for shielding said antenna element member against a noise source on the vehicle, said means being positioned between said antenna element member and the noise source so as to at least partly surround said antenna element member.

17. An antenna unit for a vehicle comprising:

a grounding plate located on the underside of said vehicle;

a first open loop element fixedly attached to said grounding plate, having first and second ends located downward away from said grounding plate;

an antenna plate suspended below said grounding plate said by resilient non-conductive mounting means;

a second open loop element fixedly attached to said antenna plate, having first and second ends located above said plate so as to be proximal to said first and second ends of said grounding plate respectively, said first open loop element first end and said second open loop element second end comprising an antenna feed terminal;

a tuning means, composed of a predetermined length of a conductor connecting said first open loop element second end and said second open loop element second end, such that a resonant frequency of said antenna unit can be selected by selecting a corresponding length of said conductor.

* * * * *